US005457357A

United States Patent [19]

Fujii et al.

[11] Patent Number: 5,457,357

[45] Date of Patent: Oct. 10, 1995

[54] ORGANIC ELECTROLUMINESCENT DEVICE HAVING IMPROVED DURABILITY AND PRODUCING METHOD THEREOF

[75] Inventors: Takanori Fujii; Takeshi Sano; Masayuki Fujita; Yoshitaka Nishio; Yuji Hamada; Kenichi Shibata, all of Osaka, Japan

[73] Assignee: Sanyo Electric Co., Ltd., Osaka, Japan

[21] Appl. No.: 56,623

[22] Filed: May 4, 1993

[30] Foreign Application Priority Data

May 19, 1992 [JP] Japan ..... 4-126396

[51] Int. Cl.[6] ..... H01J 1/62

[52] U.S. Cl. ..... 313/506

[58] Field of Search ..... 313/504, 506, 313/498; 345/76; 428/917

[56] References Cited

U.S. PATENT DOCUMENTS 4,767,679 8/1988 Kawachi ..... 428/917

5,306,572 4/1994 Ohashi et al. ..... 313/504

FOREIGN PATENT DOCUMENTS 212792 1/1990 Japan ..... 428/917

3141588 6/1991 Japan ..... H05B 33/26

*Primary Examiner*—Stephen Brinich

*Assistant Examiner*—Jerome Grant, II

*Attorney, Agent, or Firm*—Merchant, Gould, Smith, Edell, Welter & Schmidt

[57] ABSTRACT

An electroluminescent (EL) device is disclosed which has a pair of electrodes, an organic film therebetween including at least organic emitting material, and a vacuum evaporated metal film extending from the electrodes on to the outer surface of the organic film. The metal film protects at least an area on the outer surface of the organic film against air. The area is part of the border between the exposed area of the organic film and one of the electrodes, the part of the border corresponding to the crossing region of the electrodes and its vicinity.

14 Claims, 4 Drawing Sheets

ORGANIC ELECTROLUMINESCENT DEVICE HAVING IMPROVED DURABILITY AND PRODUCING METHOD THEREOF

BACKGROUND OF THE INVENTION (1) Field of the Invention

This invention relates to an organic electroluminescent device comprising a pair of electrodes and an organic film disposed therebetween.

(2) Related Arts

Electroluminescent (hereinafter referred to as EL) devices are divided between inorganic and organic, the latter being very hopeful as new display devices with the advantages of managing with low voltage and easily producing any desired emitting colors.

Of such organic EL devices, the main stream of the present research is one whose structure is called "DH structure", which is described in C. Adachi et. al., J.J.A.P. Vol. 27, No. 2, L269 (1988).

An EL device having typical DH structure comprises, as shown in FIG. 1, a glass substrate 61, a hole injection electrode 62, an organic film consisting of three layers: an organic hole transport layer 63, an organic emitting layer 64 and an organic electron transport layer 65, and an electron injection electrode 66 layered in this order.

Other organic EL devices have either so-called "SH-A" structure having no organic electron transport layer or "SH-B" structure having no organic hole transport layer. The main stream of the present research among them is an organic EL device having the SH-A structure comprising an organic hole transport layer and an organic emitting layer as the organic film between a positive and negative electrodes, which is described in C. W. Tang., et. al., Appl. Phsy. Lett. Vol. 51, No. 12,913 (1987).

These organic EL devices having the above-mentioned structures have the disadvantage of being deteriorated or flaked, while they are being used for hours, by moisture or oxygen in the air. The air intrudes from the border between an exposed area of the organic film and the edge of the adjacent electrode. As a result, non-emitting area in the EL device expands, not maintaining the designed emitting area any more. This problem seriously matters to an apparatus demanding highly accurate resolution such as dot matrix display.

One of the conventional methods to avoid such deterioration of the EL devices caused by moisture or oxygen in the air is to coat the entire EL device with a protecting film made from resin such as acrylic.

However, this method has the following problems:

The resin does not always adhere to the entire surface of the EL device perfectly, thereby leaving slight room between the resin film and the surface of the EL device, through which the air might intrude.

The EL device that has been produced in the vacuum must be put out in the atmosphere to execute such coating process of resin. During the execution, the EL device is exposed to moisture and oxygen, which might spoil the protecting film under formation. Thus the EL device begins to be subjected to damage as soon as it is made up.

SUMMARY OF THE INVENTION

Therefore, the object of this invention is to provide a high performing EL device not easily deteriorated because of its protecting film with good adhesion capable of being produced in the vacuum, and the producing method thereof.

The object can be achieved by using a metal film as the protecting film, which can be produced by vacuum evaporation. According to such vacuum evaporation, almost every atom of the metal firmly adheres onto the surface of the EL device, and as a consequence, the adhesion between the surface of the EL device and the metal film is improved, compared with the protecting films produced in the conventional methods. As a result, the deterioration of the EL device which starts from an area the coating was not sufficient can be prevented.

The metal film is provided over an area on the outer surface of the organic film, which corresponds to the periphery of the electrodes, and where a pair of electrodes cross each other. The metal film is thus provided because the area is where the emission is produced, so that damage on the area would hinder the exhibition. Since evaporation of the metal film can be done as a part of producing the EL device in the vacuum, the EL device never get in contact with the air while it is being coated with the metal film. Accordingly, it never happens that oxygen or moisture in the air intrude into the metal film, thereby preventing the EL device from being deteriorated.

Such metals used for the metal film must have lower carrier injection property than the electrode to be coated therewith, thus preventing the metal itself from becoming an emitting electrode. In other words, metals having lower electron injection properties, or larger work function can be used for the metal film to coat the electron injection electrode (cathode), and metals having lower hole injection properties, or smaller work function can be used to coat the hole injection electrode (anode).

As described hereinbefore, according to the present invention, using a metal film as the protecting film makes the adhesion between the film and the surface of the EL device better, and the film coating process be a part of the EL device production in the vacuum. Thus the deterioration of the EL device caused by the moisture or oxygen in the atmosphere can be prevented, the designed emitting area being maintained. Hence the durability of the EL device can be improved.

BRIEF DESCRIPTION OF THE DRAWINGS

These and other objects, advantages and features of the invention will become apparent from the following description thereof taken in conjunction with the accompanying drawings which illustrate an specific embodiment of the invention. In the drawings.

DESCRIPTION OF THE PREFERRED EMBODIMENTS

<Embodiment 1>

(EXAMPLE 1)

Figure 1:
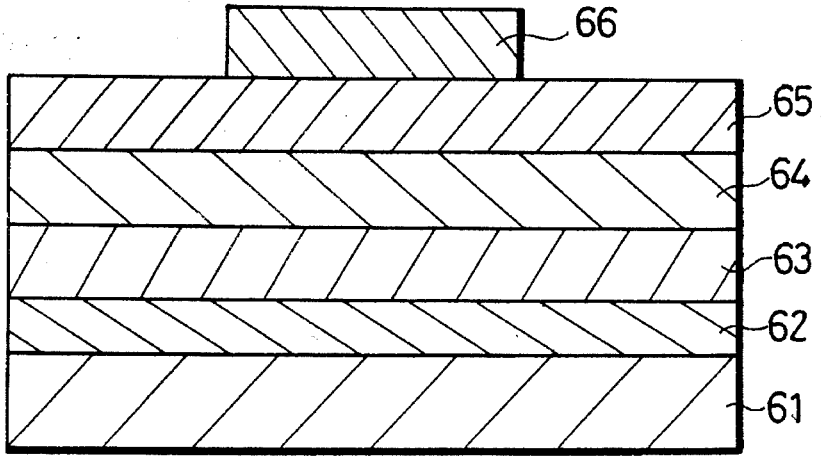
FIG. 1 is a sectional view of a conventional EL device.
Figure 2:
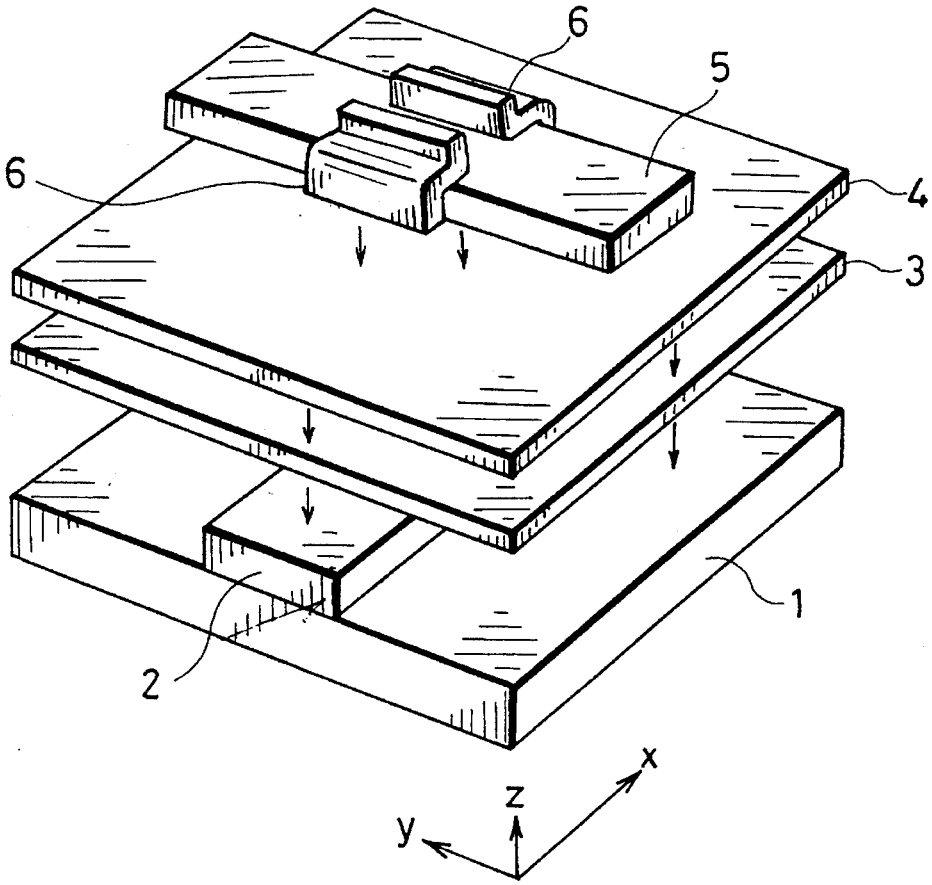
FIG. 2 is a perspective view of the EL device of the embodiment of this invention.

As shown in FIG. 2, the EL device of Embodiment 1 of this invention comprises a smooth glass substrate 1, a hole injection electrode (anode) 2 having about 2 mm width, an organic hole transport layer 3 (thickness: 100 Å), an organic emitting layer 4 (thickness: 900 Å), and an electron injection electrode (cathode) 5 having about 2 mm width layered in this order. The electrodes 2 and 5 are respectively layered longitudinally parallel to X-axis and Y-axis shown in FIGS. 2 and 3.

Figure 3:
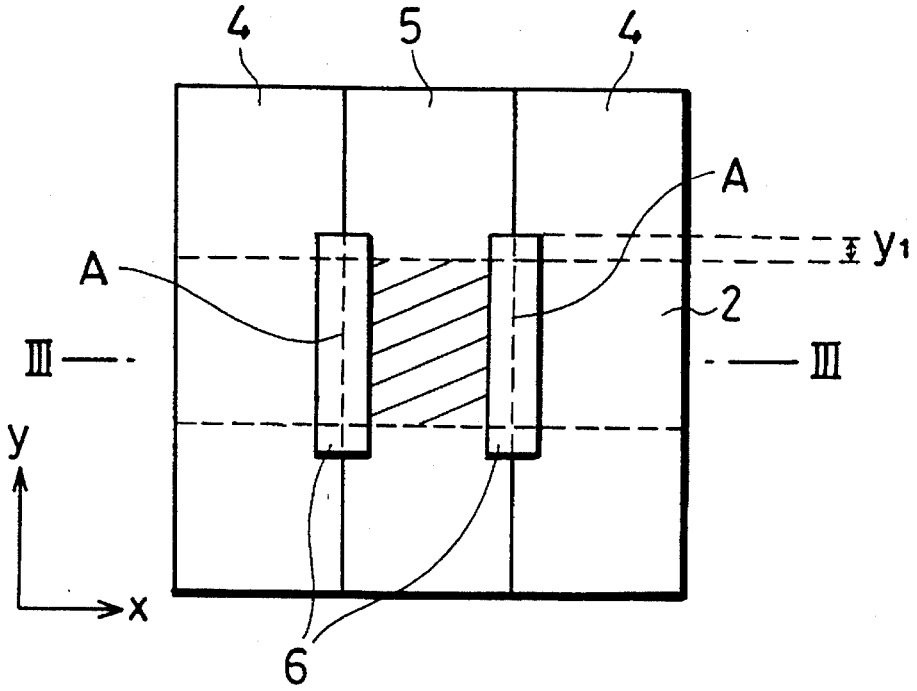
FIG. 3 is a top view of the main part of the EL device of the same.
Figure 4:
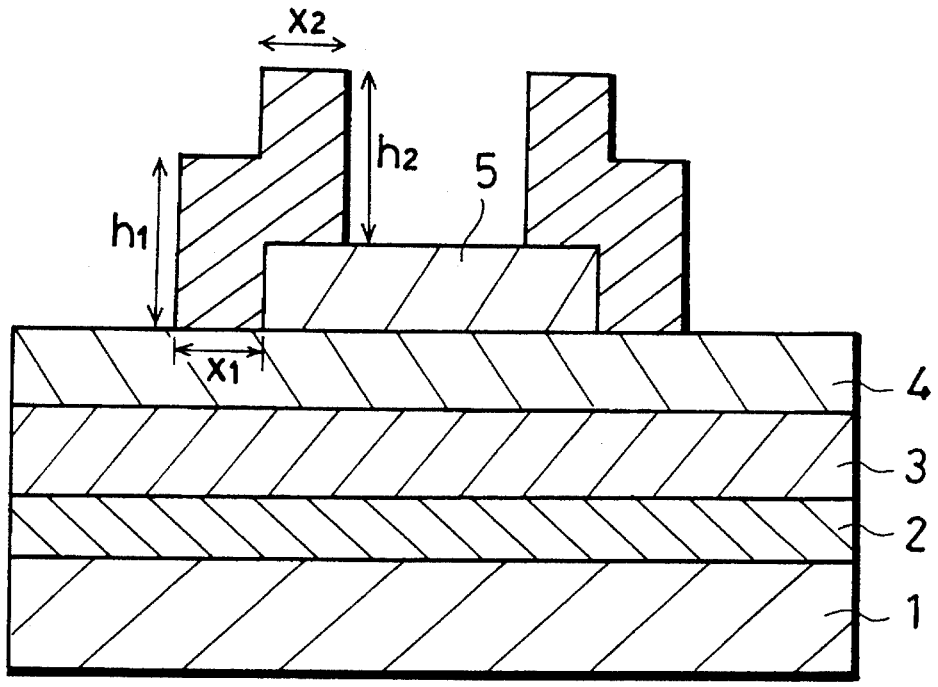
FIG. 4 is a sectional view of the EL device of the same and is taken along the line III—III.

Furthermore, the upper surface of the organic emitting layer 4 is partially coated with a metal film 6 as shown in FIGS. 2, 3, and 4. The 'partially' means the vicinity of where both electrodes 2 and 5 oppose each other, and another area A shown in FIG. 3 extending from a side surface on to the upper surface of the electron injection electrode 5. The metal film 6 has a thickness of 2000 Å both at $h_1$ and $h_2$ shown in FIG. 4, a length of 0.5 mm at $x_1$, $x_2$ and $y_1$ shown in FIGS. 3 and 4. Since the metal film 6 is formed adjacent to the electron injection electrode 5, a metal having a larger work function than that must be used. In this embodiment, the electrode 5 is composed of an Mg—In alloy whose work function is 3.7 eV, so that aluminum having 4.3 eV work function was used for the metal film 6.

The hole injection electrode 2 is composed of In—Sn oxide (ITO), the organic hole transport layer 3 is composed of poly-N-vinylcarbazole, and the organic emitting layer 4 is composed of tris (8-quinolinol) aluminum.

The EL device having the above-mentioned structure was produced as follows:

First, the glass substrate 1 was coated its upper surface with ITO film. The film was patterned in 2 mm width to form the hole injection electrode 2. Poly-N-vinylcarbazole and then tris (8-quinolinol) aluminum were evaporated thereon in about $1\times10^{-6}$Torr of vacuum to form the organic hole transport layer 3 and the organic emitting layer 4 respectively. Then, with the use of a metal mask, an Mg—In alloy was evaporated thereon to form the 2 mm wide electron injection electrode 5 right across the hole injection electrode 2. Finally, aluminum as the metal film 6 was evaporated over the area A with a metal mask again.

The EL device thus produced is hereinafter referred to as (a) device.

(Comparative Example)

Figure 5:
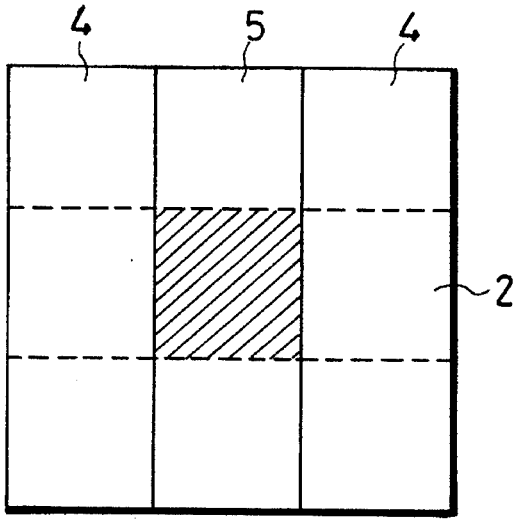
FIG. 5 is a top view of the EL device of the comparative example.

As shown in FIG. 5, an EL device of this example was produced in the same manner as in Example 1 except that the metal film 6 was not provided.

The EL device thus produced is hereinafter referred to as (x) device.

(Experiment)

Figure 6:
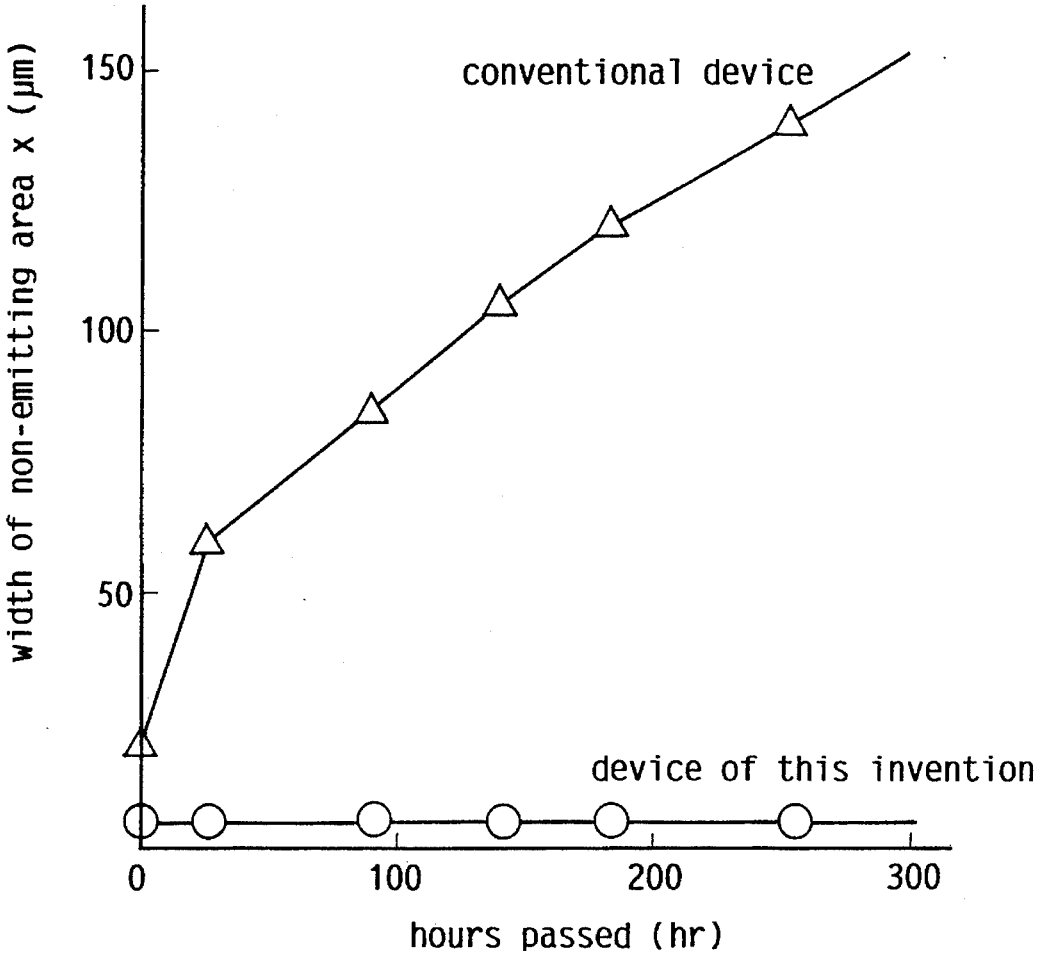
FIG. 6 is a graph showing the relationship between the preservation hours and the non-emitting area of each of the EL device of this invention and the conventional one.

The relationship between the preservation hours and the increase of non-emitting area of each of the EL devices (a) and (x) were measured. Both devices were preserved in the atmosphere and the measurement was taken when 25, 90, 140, 180, and 250 hours passed. The results are shown in FIG. 6.

Figure 7:
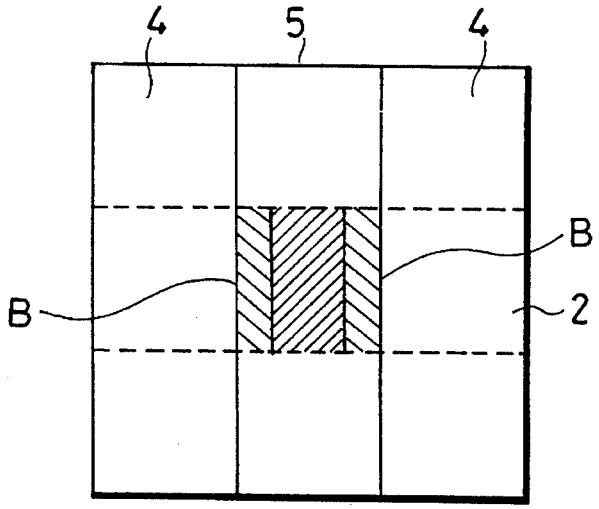
FIG. 7 is a top view of the EL device of the comparative example which is deteriorated.

As apparent from the graph, non-emitting area did not grow in the (a) device thanks to the metal coating. The (x) device having no metal coating, on the other hand, began to deteriorate from a border B between an exposed area of the organic emitting layer 4 and where both the electrodes 2 and 5 oppose each other as shown in FIG. 7, non-emitting area growing with time as shown in the graph.

(Others)

1) The thickness and the range of the metal film are not limited to those mentioned in Embodiment as long as they are enough to block the intrusion of the air. Accordingly, the range should extend at least from the electrodes on to the outer surface of the organic layer.

Figure 8:
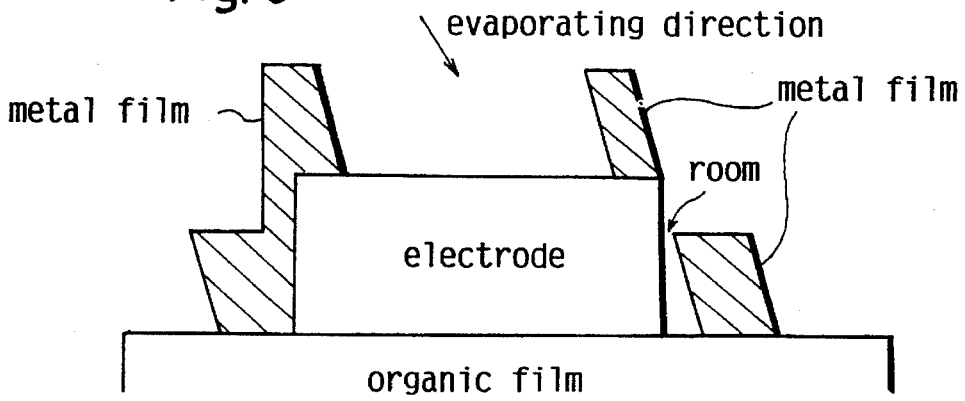
FIG. 8 is an illustration showing the thickness of the metal film.
Figure 9:
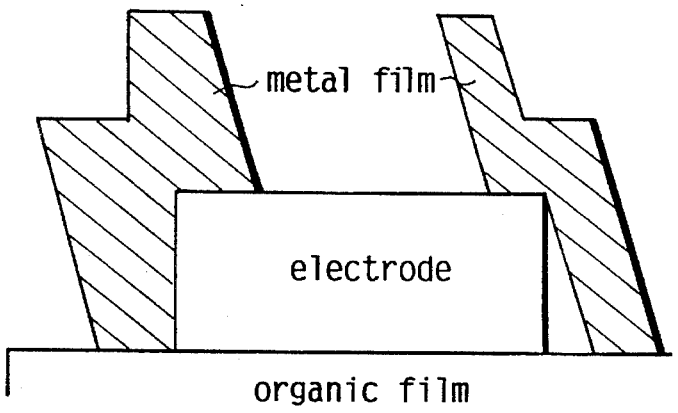
FIG. 9 is another illustration showing the thickness of the metal film.

The metal film in Embodiment was formed thicker than the adjacent electrode because if it is thinner than the electrode, the metal film, being evaporated obliquely in one direction, might fail to protect some area as shown in FIG. 8. On the other hand, with the metal film thicker than the electrode, the protection can be perfect as shown in FIG. 9.

2) It was confirmed through experiments that, when the metal film was provided by the side of the electron injection electrode 5, the following metals having large work function can be used to produce the same effects as aluminum used in the Embodiment. The metals are gold, silver, copper, iron, platinum, zinc, tin, chrome, cobalt, indium, manganese, nickel, palladium, beryllium, bismuth, cadmium, gallium, molybdenum, niobium, osmium, rhenium, ruthenium, antimony, tantalum, titan, vanadium, tungsten, zirconium, and an alloy including any of these metals.

3) Although Embodiment describes the case that the organic emitting layer 4 was partially exposed against the electron injection electrode 5, the metal coating can effect in the same way when the electron transport layer is partially exposed.

Similarly, metals having small work function can be used for the coating and effect the same when the organic emitting layer 4 or the hole transport layer 3 was exposed against the hole injection electrode 2. The metals are lithium, sodium, calcium, barium, cerium, cesium, erbium, europium, gadolinium, kalium, lanthanum, neodymium, rubidium, scandium, samarium, yttrium, ytterbium, zinc, and an alloy including any of these metals.

4) Although the single hole injection electrode and the single electron injection electrode are provided in Embodiment, they each can be more than one. In addition, the width and the crossing angle of the electrodes are not limited to those indicated in Embodiment.

5) The metal film can be provided by the side of the both electrodes.

6) The metal film of this invention can be applied, besides DH, SH-A, and SH-B structures, to a mixed single-layer structure having charge transport material containing emitting material, and to a double-layer structure having either two emitting layers or two charge transport layers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An EL device comprising a pair of electrodes, an organic film therebetween including at least organic emitting material, and a metal film extending from one of the electrodes on to the outer surface of the organic film in order to protect at least an area on the outer surface of the organic film against air, the metal film being in direct contact with said one of the electrodes, and a work function of the metal film being different from a working function of said one of the electrodes, the area being part of a border between the exposed area of the organic film and said one of the electrodes, the part of the border corresponding to the crossing region of the electrodes and its vicinity.

2. The EL device of claim 1 further having a glass substrate, wherein either one of the electrodes is disposed between the glass substrate and the organic film.

3. The EL device of claim 2, wherein the metal film is only provided on one of the electrodes that is disposed other than between the glass substrate and the organic film.

4. an EL device comprising a pair of electrodes, an organic film therebetween including at least organic emitting material, and a metal film extending from each one of the electrodes on to the outer surface of the organic film in order to protect at least an area on the outer surface of the organic film against air, the area being part of a border between the exposed area of the organic film and said one of the electrodes, the part of the border corresponding to the crossing region of the electrodes and its vicinity, wherein the electrodes are a hole injection electrode and an electron injection electrode, and the metal film provided by the side of the hole injection electrode is composed of a metal having smaller work function than the hole injection electrode, while the metal film provided by the side of the electron injection electrode is composed of a metal having larger work function than the electron injection electrode.

5. The EL device of claim 4, wherein when the hole injection electrode is composed of ITO, the metal for the metal film is selected from the group consisting of lithium, sodium, calcium, barium, cerium, cesium, erbium, europium, gadolinium, kalium, lanthanum, neodymium, rubidium, scandium, samarium, yttrium, ytterbium, zinc, and an alloy including any of these metals.

6. The EL device of claim 2, wherein when the electron injection electrode is composed of an Mg—In alloy, the metal for the metal film is selected from the group consisting of aluminum, gold, silver, copper, iron, platinum, zinc, tin, chrome, cobalt, indium, manganese, nickel, palladium, beryllium, bismuth, cadmium, gallium, molybdenum, niobium, osmium, rhenium, ruthenium, antimony, tantalum, titan, vanadium, tungsten, zirconium, and an alloy including any of these metals.

7. An EL device comprising a pair of electrodes, an organic film therebetween including at least organic emitting material, and a metal film extending from one of the electrodes on to the outer surface of the organic film in order to protect at least an area on the outer surface of the organic film against air, the area being part of a border between the exposed area of the organic film and said one of the electrodes, the part of the border corresponding to the crossing region of the electrodes and its vicinity, wherein the electrode provided with the metal film thereon is a hole injection electrode, the metal film being composed of a metal having a smaller work function than the hole injection electrode.

8. The EL device of claim 7, wherein when the hole injection electrode is composed of ITO, the metal for the metal film is selected from the group consisting of lithium, sodium, calcium, barium, cerium, cesium, erbium, europium, gadolinium, kalium, lanthanum, neodymium, rubidium, scandium, samarium, yttrium, ytterbium, zinc, and an alloy including any of these metals.

9. The EL device of claim 7 further having a glass substrate, wherein either one of the electrodes is disposed between the glass substrate and the organic film.

10. The EL device of claim 9, wherein the metal film is only provided on one of the electrodes that is disposed other than between the glass substrate and the organic film.

11. An EL device comprising a pair of electrodes, an organic film therebetween including at least organic emitting material, and a metal film extending from one of the electrodes on to the outer surface of the organic film in order to protect at least an area on the outer surface of the organic film against air, the area being part of a border between the exposed area of the organic film and said one of the electrodes, the part of the border corresponding to the crossing region of the electrodes and its vicinity, wherein the electrode provided with the metal film thereon is an electron injection electrode, the metal film being composed of a metal having a larger work function than the electron injection electrode.

12. The EL device of claim 11, wherein when the electron injection electrode is composed of an Mg—In alloy, the metal for the metal film is selected from the group consisting of aluminum, gold, silver, copper, iron, platinum, zinc, tin, chrome, cobalt, indium, manganese, nickel, palladium, beryllium, bismuth, cadmium, gallium, molybdenum, niobium, osmium, rhenium, ruthenium, antimony, tantalum, titan, vanadium, tungsten, zirconium, and an alloy including any of these metals.

13. The EL device of claim 11 further having a glass substrate, wherein either one of the electrodes is disposed between the glass substrate and the organic film.

14. The EL device of claim 13, wherein the metal film is only provided on one of the electrodes that is disposed other than between the glass substrate and the organic film.

* * * * *